United States Patent [19]

Lemmens et al.

[11] Patent Number: 4,728,164

[45] Date of Patent: Mar. 1, 1988

[54] ELECTRICAL CONTACT PIN FOR PRINTED CIRCUIT BOARD

[75] Inventors: Johan C. W. Lemmens, Udenhout; Hendricus J. A. Van Ierland, Tilburg, both of Netherlands

[73] Assignee: E. I. Du Pont de Nemours and Company, Wilmington, Del.

[21] Appl. No.: 885,045

[22] Filed: Jul. 14, 1986

[30] Foreign Application Priority Data

Jul. 16, 1985 [NL] Netherlands ..... 8502046

[51] Int. Cl.[4] ..... H01R 13/428

[52] U.S. Cl. ..... 439/870; 439/82; 439/873; 439/84

[58] Field of Search ..... 339/221 R, 221 M, 220 R, 339/220 A, 220 C, 220 L, 220 T, 17 C, 252 R, 252 P, 221 L

[56] References Cited

U.S. PATENT DOCUMENTS 3,670,294 6/1972 Johnson et al. ..... 339/195
3,824,554 7/1974 Shoholm ..... 339/221
3,827,004 7/1974 Heuvel et al. ..... 339/221
4,057,315 11/1977 Miller et al. ..... 339/221 R
4,274,699 6/1981 Keim ..... 339/176 MP
4,464,009 8/1984 Thaler ..... 339/252
4,469,394 9/1984 Verhoeven ..... 339/221 R

FOREIGN PATENT DOCUMENTS 0088582 9/1983 European Pat. Off. .

*Primary Examiner*—Gil Weidenfeld
*Assistant Examiner*—Gary F. Paumen

[57] ABSTRACT

An electrical contact pin for mounting in a printed circuit board. The pin has an H-shaped contact portion cross-section which is mounted in the hole by compliant press-fit action. The H-shaped cross-section comprises four compliant pins and a crossbar. The floor of the crossbar is V-shaped and the transition between the pins and floor is rounded. The height and thickness of the fins on each side of the V-shaped floor are substantially the same, thereby minimizing or eliminating rotation of the pin during insertion into the hole.

3 Claims, 9 Drawing Figures

ELECTRICAL CONTACT PIN FOR PRINTED CIRCUIT BOARD

BACKGROUND OF THE INVENTION

The present invention relates to an electrical contact pin for mounting in a plated-through hole in a printed circuit board. More particularly, this invention relates to a contact pin which has a contact section which interacts with the hole and the metallization therein. The cross-section of the contact section is in the shape of an H and has four projecting bendable fins along the legs of the H which extend over the longitudinal distance of the contact section and thereby define two longitudinal recesses situated on both sides of the crossbar. A contact pin of this type is described in U.S. Pat. No. 3,827,004 granted July 30, 1984 and assigned to the same assignee as the present application.

In the case of the contact pin disclosed in U.S. Pat. No. 3,827,004, the four fins are gradually bent inwards when the pin is introduced into the hole in the printed circuit board so that the contact section is fixed at four points in the hole. The H-shaped construction reduces or eliminates the risk of rotating the pin during mounting. As a result, square pins of the type used on a large scale in the printed circuit board industry can then be used. The pairs of fins situated on both sides of the transverse section of the H-shaped contact section project perpendicularly from the said transverse section of the pin. In the introduction and final fixing of the contact section of the pin in the respective hole it is of the greatest importance that the projecting fins are constructed absolutely symmetrically and have the same thickness so that during the insertion movement into the hole all four are bent uniformly and grip the metallization in the hole. Even with very small differences in the thickness, and consequently in the stiffness, of the projecting fins, a different force acting on each fin will consequently occur on introducing the contact section into the hole. Rotation or eccentric positioning of the pin will result. This may cause serious damage to the metallization in the hole and even positioning of the pin becomes very difficult.

In practice these pins are almost always made from square wire or flat tape material, the recesses of the contact section being formed by stamping technology and the fins being forced outwards or extruded.

As a result of the flat floor on either side of the crossbar of the H-shaped contact section and the dies used for this purpose, the recesses are not completely centered and symmetrically formed in the stamping operation. As a result of the "floating" of the stamping operation, a truly absolute centering of the resultant recess is not obtained. Consequently, the fins obtained on both sides of the recess are virtually never of truly equal thickness or height. On introducing a contact section of this type into the hole of the printed circuit board, an unequal distribution of force occurs and one fin will bend earlier as a result of the lesser thickness, which in turn may cause the pin to rotate. This may damage the metallization more than is minimally acceptable and even positioning of the pin may become impossible.

A further problem is that, due to the sharp angles which the fins make with the flat floor of the crossbar section of the H-shaped contact section. bending and or even cracking easily occurs in these angles during the insertion movement.

A different version of such a H-shaped pin is described in U.S. Pat. No. 4,469,394 granted Sept. 4, 1984, and also assigned to the same assignee as the present invention. The contact pin described in the patent has a serrated floor in order to better control the height of the fins. The extension which occurs during the deformations was found to be a disadvantage. It was possible to solve this partially by using this serrated floor, but not as yet with the desired result in relation to the desired symmetry.

SUMMARY OF THE INVENTION

The electrical contact pin of the present invention solves the above problems by providing a contact pin having an associated contact section, in which an absolutely symmetrical recess is obtained after manufacture of the material of the projecting fins on both sides of the recess having equal thickness.

In the contact pin according to the present invention, each longitudinal recess has a V-shaped floor in the crossbar, which is formed first by means of corresponding knife-shaped dies during the forming of the longitudinal recesses and, as precentering for the more deeply penetrating stamping operation for the longitudinal recess, provides for a symmetrical execution thereof. The fins produced in the process on both sides of the recess acquire the same height and thickness and that the transition from the V-shaped floor to the fins on both sides of the recess is rounded off.

BRIEF DESCRIPTION OF THE DRAWINGS

The invention will be explained in more detail on the basis of an exemplary embodiment with reference to the drawings in which the same components are indicated in the different figures by the same reference numerals, and in which.

Figure 1:
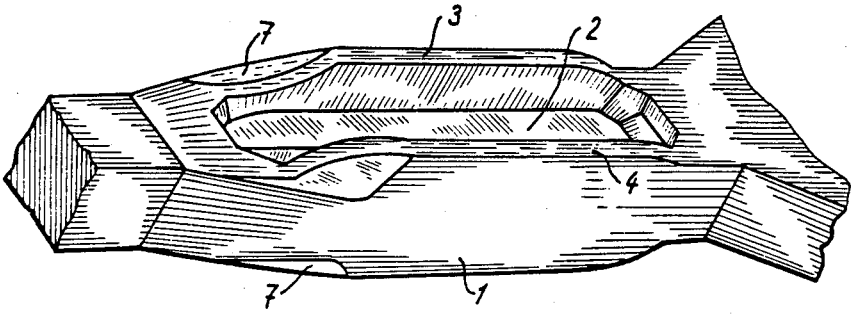
FIG. 1 is a perspective view of the contact section of a contact pin according to the invention.
Figure 3:
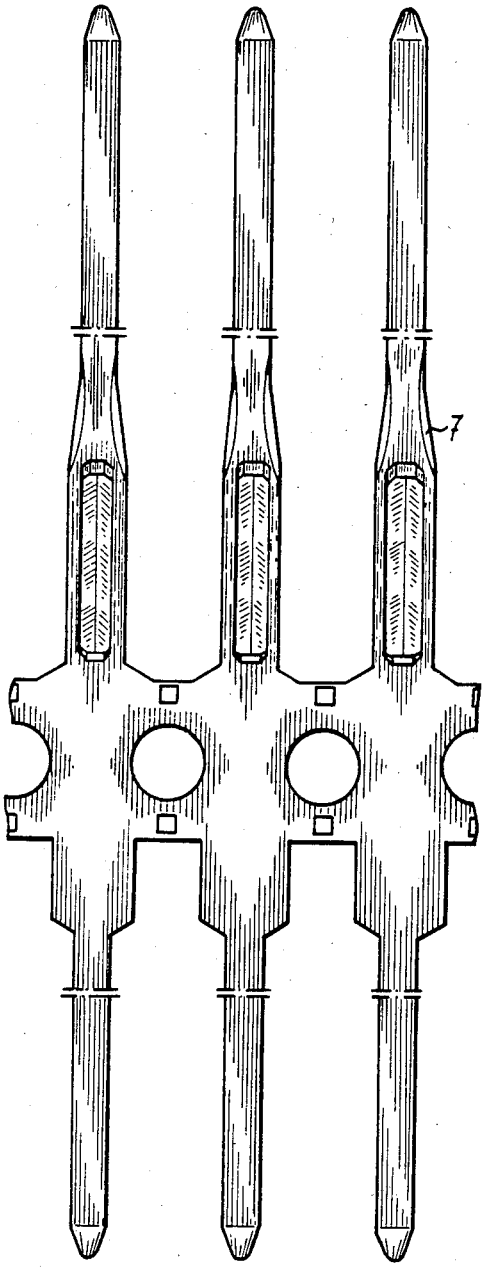
Figure 4:
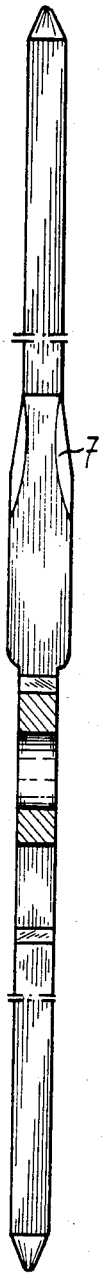

FIG. *2a* and FIG. *2b* are, respectively, cross-sectional views of the contact section of FIG. 1 and of a prior art contact pin;

FIGS. *2c–2f* show cross-sections of individual embodiment versions of contact pins according to the invention;

FIG. 3 is a plan view of a number of contact pins made from tape material which are still attached to the strip of tape; and FIG. 4 is a side view of a contact pin from FIG. 3.

DESCRIPTION OF THE PREFERRED EMBODIMENTS

In FIG. 1 the contact section is in general indicated by 1, the recess on one side of the contact section by 2, the two fins on both sides of the recess by 3 and 4, and the gradually decreasing transition, inclined inwards, from the fins to the remaining section of the pin by 7. In FIG. *2a*, the cross-sectional view (of FIG. 1) is shown with V-shaped floor 5 in recess 2 and with the rounded-off angle 6 between the V-shaped floor and each projecting fin added. For comparison, in FIG. *2b*, a cross-sectional view is shown of the contact section of a prior art pin. The flat floor of the recess and the right angle between this floor and each projecting fin are clearly evident. In the prior pin, two V-shaped depressions are made on the side walls in order to be able to influence the height of the fins.

Figure 2B:
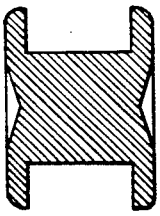
fig-2b (Prior Art)

From the views in FIGS. 1 and *2a*, the V-shaped floor is clearly evident in the crossbar of the H-shape in the recesses situated opposite each other in the contact section of the pin. During manufacture, this results in an exceptionally reliable and symmetrical stamping operation, as a result of which the recess is stamped out completely symmetrically in the contact section. As a result, the two projecting fins on both sides of the recess are of absolutely equal thickness. In other words, as a result of the V-form of the two dies situated opposite each other during the stamping operation a tracking effect is obtained during the stamping operation with an absolutely reliable centering of the recess as a result. This is in contrast to the prior art, such a shown in FIG. 2*b*, in which, as a result of the flat floor, a "floating" is encountered during the stamping operation with which results in an imprecise centering of the recess as a result and consequently an unequal thickness of the two projecting fins.

Figure 2A:
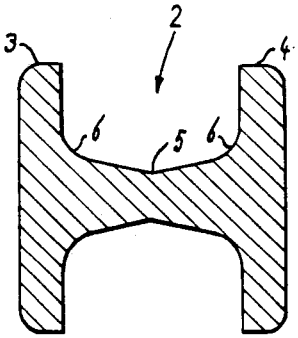

In FIGS. 1 and 2*a*, the rounding off between the projecting fins and the V-shaped floor is also clearly visible. As a result of this rounded-off transition, a stiffening of the initial section of the projecting fin is achieved. Bending or cracking is thereby avoided during the introduction of the contact section into the hole in the printed circuit board.

As a result of the exceptionally reliable centering of the forming of the recess, it is now possible to manufacture the contact pins from tape material which is per se substantially softer and better to work, in contrast to the state of the art in which the contact pins were principally made from square wire or hard drawn wire material.

Figure 2C:
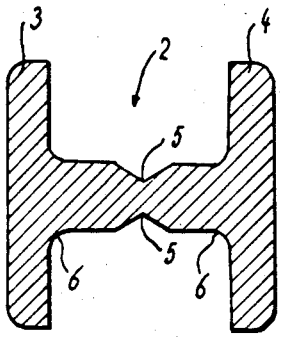
Figure 2D:
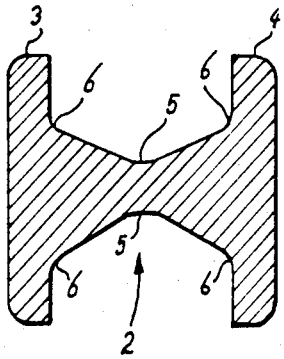
Figure 2E:
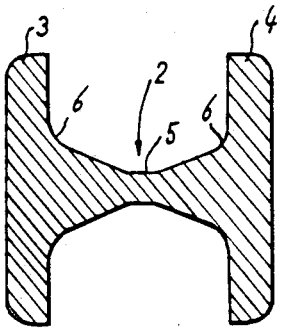
Figure 2F:
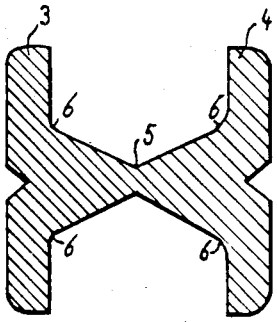

FIGS. 2*c*–2*f* show cross-sections of embodiment variations of contact pins according to the invention. The essential point in each of these embodiment variations is the V-shaped floor. In FIG. 2*c*, this forms a part of the crossbar. In FIG. 2*d*, the parts between the rounded-off angle 6 and the V-shaped bottom are bent in a circular manner. In FIG. 2*e* there is a short straight part in the V-shaped floor, while in FIG. 2*f* the parts between the rounded-off angle 6 and the V-shaped floor 5 are straight.

FIG. 3 shows a plan view of three contact pins punched out of a strip of tape. FIG. 4 illustrates a side view of a contact pin from FIG. 3. Owing to the gradually increasing and inwardly inclined transition 7 from the straight pin section to the contact section 2, a smooth introduction of the contact pin into a metallized hole in a printed circuit board is obtained without damage to the metallization therein.

In certain circumstances a number of contact pins can be introduced simultaneously into the corresponding holes of the printed circuit board, the contact pins only being broken off the main strip of tape after the insertion of the contact pins. If required, the operation of soldering the contact sections of each contact pin in the respective hole in the printed circuit board may follow.

Although preferred embodiments have been described, it should be understood that the present invention is not limited to the embodiments shown and that modifications and additions are possible without departing from the scope of the invention. For example, although the preferred embodiments have been described in terms of male pins, the invention applies equally to other types of terminals such as in female connector applications.

We claim:

1. An electrical pin for mounting in a hole of an electrical component such as a printed circuit board, said pin comprising a longitudinal contact section which interacts with the hole when inserted therein, said contact section being of generally H-shape in cross-section formed by four projecting fins extending generally parallel to the longitudinal axis of the pin and interconnected by a central crossbar along the length of the contact section, said fins and crossbar defining two longitudinal recesses disposed on both sides of the crossbar, each longitudinal recess having a V-shaped floor along said crossbar with the V-shape extending parallel to the longitudinal axis of the pin, the fins on both sides of each longitudinal recess being of the same height and thickness and the transition from the V-shaped floor to the pins on both sides of each recess being rounded.

2. An electrical contact pin according to claim 1, wherein the height of said pin is substantially the same over the length of the contact section, the height decreasing gradually only near the ends of the contact section in a transition section from the contact section to the remainder of the pin, said transition section also being inwardly inclined to provide for a centered and smooth introduction of the pin into the hole.

3. An electrical contact pin according to claim 1, wherein the V-shaped floor in the crossbar is formed by means of corresponding knife-shaped dies during the forming of the longitudinal recesses, the V-shape providing a precentering for a more deeply penetrating stamping operation to form the longitudinal recesses, thereby resulting in symmetrical fins of the same height and thickness on each side of the recess.

* * * * *